US007765616B2

(12) United States Patent
Gammons

(10) Patent No.: US 7,765,616 B2
(45) Date of Patent: Aug. 3, 2010

(54) THERMAL TRANSFER DEVICE WITH RESTRICTION-RESISTANT TUBING

(75) Inventor: Clifford E. Gammons, Loudon, TN (US)

(73) Assignee: Adroit Development, Inc., Loudon, TN (US)

( * ) Notice: Subject to any disclaimer, the term of this patent is extended or adjusted under 35 U.S.C. 154(b) by 243 days.

(21) Appl. No.: 11/946,705

(22) Filed: Nov. 28, 2007

(65) Prior Publication Data

US 2009/0133853 A1 May 28, 2009

(51) Int. Cl.
*A41D 13/00* (2006.01)

(52) U.S. Cl. ..... 2/115

(58) Field of Classification Search ..... 2/102, 2/108, 69, DIG. 3, 94, 113, 115
See application file for complete search history.

(56) References Cited

U.S. PATENT DOCUMENTS 4,024,730 A 5/1977 Bell et al.
4,451,934 A * 6/1984 Gioello ..... 2/113
5,515,543 A * 5/1996 Gioello ..... 2/69
6,109,338 A 8/2000 Butzer
6,565,699 B1 5/2003 Szczesuil et al.
2007/0085340 A1 4/2007 Gammons

* cited by examiner

*Primary Examiner*—Tejash Patel
(74) *Attorney, Agent, or Firm*—Knox Patents; Thomas A. Kulaga

(57) ABSTRACT

An apparatus for selectively heating and cooling a body via a garment and attached heat transfer tubing. Operation of the garment is unaffected by external loads applied to the garment, such as backpack straps or harnesses. The garment includes restriction-resistant heat transfer tubing. The tubing is made of flexible, resilient material and has a lumen through which temperature-controlled fluid flows. In one embodiment, the lumen includes three internal protrusions or ribs extending radially from the inner wall and rounded at the tip. When an external load is applied to the tubing the internal ribs prevent complete closure of the lumen because the ribs provide support that separates the opposite sides of the tubing. The ribs, therefore, resist restriction of the flow of the heat transfer fluid. In various embodiments, the tubing and ribs take on different shapes while maintaining an open lumen through which temperature-controlled fluid may flow.

20 Claims, 2 Drawing Sheets

THERMAL TRANSFER DEVICE WITH RESTRICTION-RESISTANT TUBING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to an apparatus for selectively heating and cooling a body. More particularly, this invention pertains to the tubing that carries a temperature-controlled fluid over the surface of a garment worn on the body of a person and the tubing has an internal construction configured to resist restriction of the fluid flow when an external load, or force, is applied to the tubing.

2. Description of the Related Art

Oftentimes, individuals must perform tasks in extreme temperature environments. When the ambient temperature is very cold, an individual can wear insulative layers of clothing, although at the expense of mobility, flexibility, and overall size. When the ambient temperature is very hot, the individual can remove only so much clothing in order to obtain relief. In order to perform tasks in these extreme temperature environments, the individual can wear a garment that includes a heat transfer mechanism to allow the individual to endure the extreme temperature environment. These garments typically have tubing routed over the surface of the garment, and the tubing carries a temperature-controlled fluid.

One such garment is disclosed in U.S. Pat. No. 4,024,730, titled "Integrated cooling and breathing system," issued to Bell, et al., on May 24, 1977. The '730 patent discloses an integrated cooling and breathing system for crewmembers aboard an aircraft. The '730 patent further discloses a crewmember 39 wearing a liquid-loop cooling garment 55 that includes "a capillary-like system of flexible tubing 53 integral with a nylon fabric underwear-like suite."

U.S. Pat. No. 6,109,338, titled "Article comprising a garment or other textile structure for use in controlling body temperature," issued to Butzer on Aug. 29, 2000, discloses a garment with pockets and tube casings for use in cooling body temperature. The '388 patent discloses a system of heat transfer patches within the garment which are fluidly connected by tubing routed through tube casings.

U.S. Pat. No. 6,565,699, titled "Method and apparatus for making body heating and cooling garments," issued to Szczesuil, et al., on May 20, 2003, discloses a method of fabricating garments with fluid carrying tubing. The '699 patent discloses a garment that includes heating or cooling tubing dispersed throughout the garment. The tubing of the '699 patent is supplied with heating or cooling fluids via an umbilical connection line which is connected to a heating/cooling unit.

Oftentimes, when an individual is performing a task in an extreme temperature environment, the individual must also wear other equipment, such as an air-supply pack or a backpack, or the individual must be strapped into a seat with a harness. Such equipment and/or harness is often secured tightly to the individual with straps. These straps press against the heat transfer tubing, causing the tubing to collapse and thereby restricting flow of the temperature-controlled fluid and limiting the temperature control available to the user. Accordingly, there is a need to have a garment that remains functional when an individual is performing tasks requiring a piece of equipment and/or a harness that is supported by the body of the person.

One approach to resolve this restriction of flow is disclosed in U.S. patent application Ser. No. 11/562,788, titled "Upper Body Heating an Cooling Apparatus and Method of Making Same," filed Nov. 22, 2006, incorporated by reference, which discloses a garment with a load bearing area and a heat transfer area. The load bearing area is identified at the shoulders of the upper body. The heat transfer tubing is located away from the load bearing area to avoid a fluid flow restriction in that area.

BRIEF SUMMARY OF THE INVENTION

According to one embodiment of the present invention, a garment with heat transfer tubing is provided. The garment has an outside surface. The heat transfer tubing is attached to the garment, in one embodiment, by sewing the tubing to the outside surface of the garment. The tubing defines a lumen that carries a temperature-controlled fluid that provides cooling or heating to the body. The tubing has internal features that keep the lumen open when pinched, or compressed, by an external load, such as the straps of a backpack or of a harness worn over the garment.

One embodiment of the tubing has three ribs that protrude into the lumen and run longitudinally along the length of the tubing. The ribs are dimensioned and configured such that the lumen is not closed when an outside force is applied to the tubing. When the tubing is deformed by the outside force such that a portion of the tubing wall is forced toward the opposite portion of the tubing wall, the tip of the ribs contact the opposite portion of the tubing wall, thereby preventing the tubing from collapsing and closing the lumen. The tubing has an inlet and an outlet. Temperature-controlled fluid flows into the inlet, runs through the tubing, and exits the outlet. When an external load is applied to the tubing, the internal ribs prevent the walls of the tube from being forced together, thus allowing the heat transfer fluid to circulate despite the external load.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for thermal transfer that includes restriction-resistant heat transfer tubing is disclosed. The illustrated embodiment is a thermal garment 100 to be worn on the upper body of a human. In other embodiments, the thermal garment 100 is configured to be worn over various portions of the body.

Figure 1:
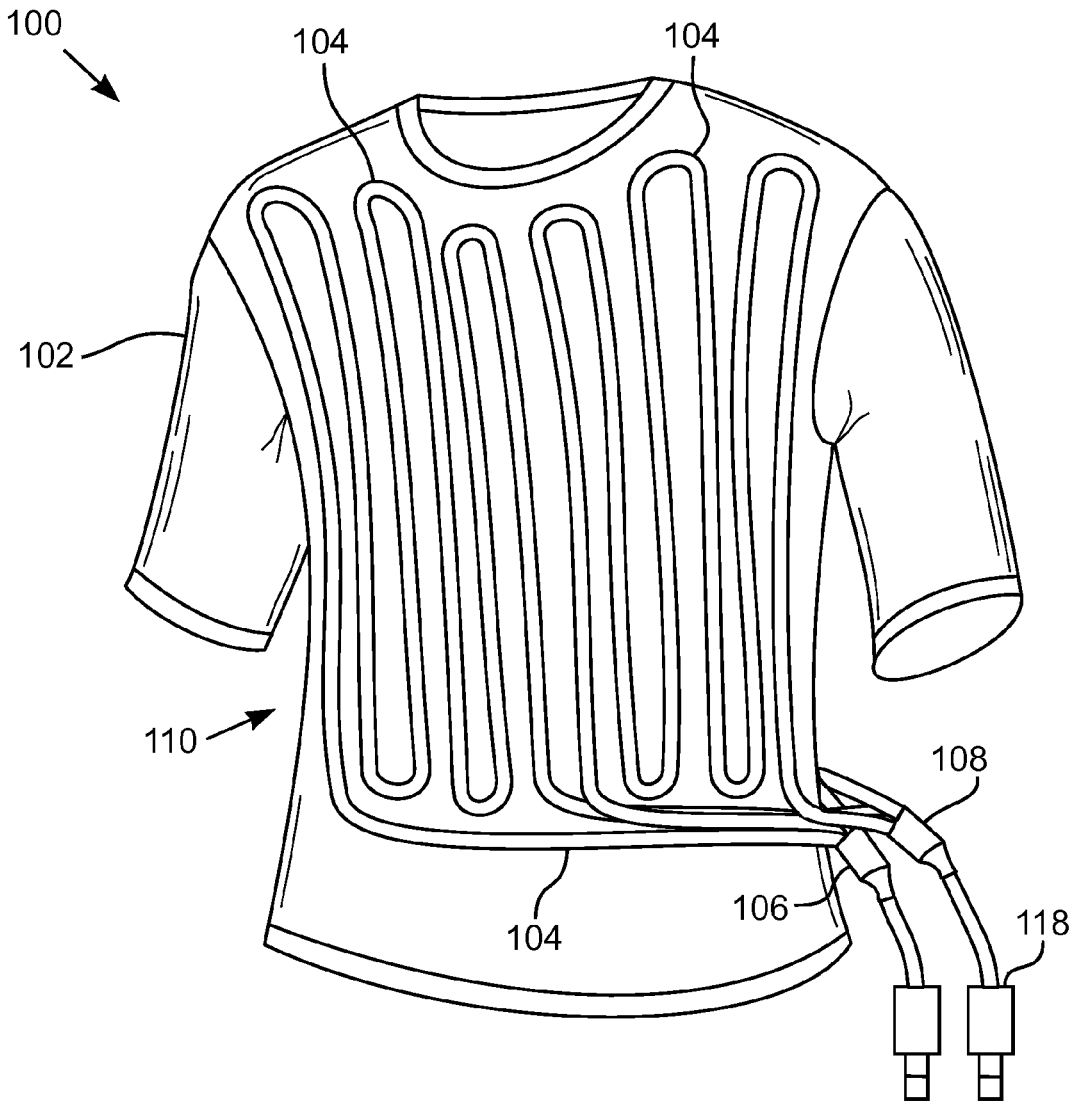
FIG. 1 is a front perspective view of one embodiment of a thermal garment with heat transfer tubing.

FIG. 1 illustrates a perspective view of one embodiment of a thermal garment 100 with heat transfer tubing 104 attached. In the illustrated embodiment, the thermal garment 100 includes a shirt 102 with heat transfer tubing 104 attached to the outside of the shirt 102. The tubing 104 is flexible, resilient, and does not appreciably stretch or compress. The tubing 104 is laid out in a serpentine manner over a heat transfer portion of the outside surface of the shirt 102 with an inlet 106 and an outlet 108 for the flow of a temperature-controlled fluid. The inlet 106 and outlet 108 of the tubing 104 are connected to connectors 118 that allow the tubing 104 to be in fluid communication with a thermal unit. The thermal unit forces a temperature-controlled fluid into the inlet 106, through the tubing 104, and out of the outlet 108. The tubing 104 is sized to accommodate the flow of fluid from the thermal unit to meet the thermal needs of the wearer.

When the temperature-controlled fluid is cooler than the ambient temperature and the body temperature of the wearer, the thermal garment 100 transfers heat from the wearer of the shirt 102 to the fluid, thereby cooling the wearer. Multiple fluid circuits allow the cooling effects to be evenly spread across the heat transfer portion 110 of the shirt 102. To maintain the comfort of the wearer, the flow of temperature-controlled fluid through the tubing 104 should not be stopped when an external load is applied to the shirt 102, such as, for example, when the shirt 102 is worn by a race car driver and the seat belt presses against the tubing 104. The external loads tend to adversely impact the heat transfer capability of the garment by causing pinching, crushing, compression, or otherwise restricting the flow of the fluid within the heat transfer tubing 104. The restriction of flow also builds up backpressure in the system that can damage the pump and motor of the thermal unit.

In the illustrated embodiment, the tubing 104 is attached to the outside of the shirt 102. In other embodiments, the tubing 104 is attached to the inside of the shirt 102, between two or more layers of material forming the garment 100, or within pockets in the garment 100.

In the illustrated embodiment, the tubing 104 is positioned on both the front and rear sides of the shirt 102 and there are two circuits of tubing 104 on the front heat transfer portion 110 of the shirt 102. In other embodiments, the tubing 104 is positioned along the sides of the upper body and/or along the arms of the shirt 102. Although the illustrated embodiment is a shirt 102 covering the upper body portion of a person, in other embodiments the thermal garment 100 covers various portions of the body of the wearer and the tubing 104 is positioned on a heat transfer portion 110 adjacent the surface of the material forming the garment 100.

Figure 2:
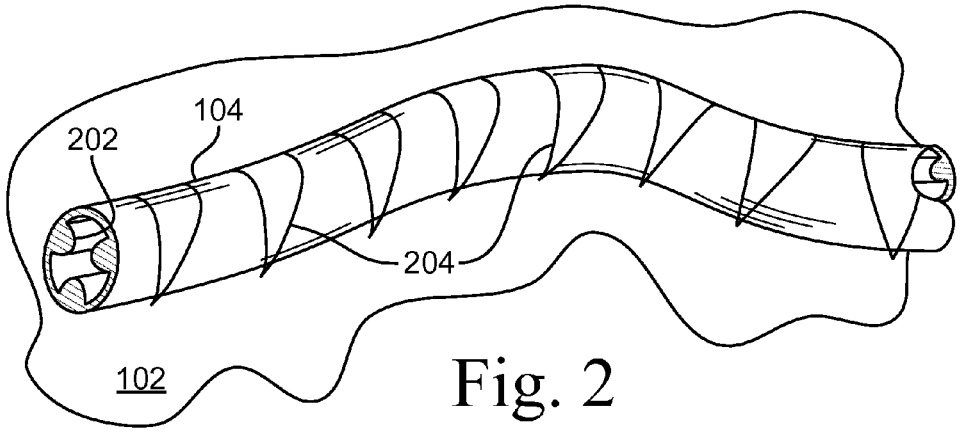
FIG. 2 is a perspective view of a short length of one embodiment of the heat transfer tubing.
Figure 3:
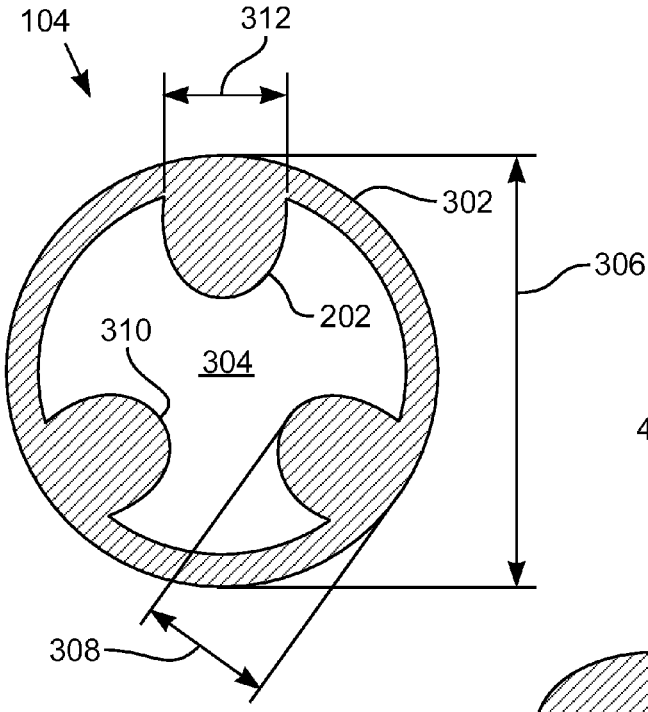
FIG. 3 is a cross-sectional view of one embodiment of the heat transfer tubing.

FIG. 2 illustrates a perspective view of a short length of one embodiment of the heat transfer tubing 104. FIG. 3 illustrates a cross-sectional view of one embodiment of the heat transfer tubing 104. In one embodiment, the tubing 104 is sewn to the fabric of the shirt 102 with thread 204 that alternates from side-to-side of the tubing 204. The illustrated embodiment of the heat transfer tubing 104 has a substantially constant circular cross-section in its relaxed state. The heat transfer tubing 104 has an outside diameter 306, a wall 302, and three internal ribs 202. The tubing wall 302 forms a lumen 304 through which the fluid flows.

The tubing wall 302 has a thickness. The type of material and thickness of the wall 302 creates an impermeable barrier to retain the fluid within the lumen 304. There exists a minimum cross-sectional area of the lumen 304 for the thermal garment 100 to function properly. Extreme temperature differentials are uncomfortable to the wearer. A larger lumen 304 allows for the use of a fluid with a more moderate temperature to effectuate the same heat transfer as a tubing with a smaller lumen 304. Assuming the wall thickness remains constant, a larger lumen 304 will require a larger outside diameter 306. The cost of heat transfer tubing 104 increases as the outside diameter 306 increases. The heat transfer tubing 104 is being used in a garment 100 that will be worn on a body, so weight is also an issue. The weight of the heat transfer tubing 104 increases as the outside diameter 306 increases where the thickness of the wall 302 remains constant. In order to minimize both cost and weight of the heat transfer tubing 104, the cross-sectional area of the lumen 304 must be minimized. The minimum cross-sectional area of the lumen 304 is dependent on the desired temperature differential between the temperature-controlled fluid and the body being treated. Another consideration for the size of the lumen 304 is the amount of pressure required to pump the fluid through the tubing 104. A very small lumen 304 creates a high back pressure that must be overcome by the pump. The designer must balance the comfort of the user and the cross-sectional area of the lumen 304, keeping in mind the cost of the pump required to circulate the fluid through the system.

In the illustrated embodiment, three internal ribs 202 extend from the wall 302 and are 120 degrees apart. In other embodiments, the number of ribs 202 varies. Each rib 202 is a longitudinal member having a width 312 and a height 308 when viewed in cross-section. In one embodiment, each rib 202 extends partially toward the center of the cylindrical-shaped tubing 104 when the tubing 104 is in its natural state as illustrated in FIGS. 2 and 3. In various embodiments, the width 312 and height 308 of the ribs 104 varies depending upon the resilience of the material of the tube 104.

The cross-sectional area of the lumen 304 for a conduit with a simple circular inside diameter is decreased when the internal ribs 202 are added. To maintain the same cross-sectional area as a lumen 304 without protruding internal ribs 202, the outside diameter 306 of the heat transfer tubing 104 is increased to compensate for the area of the protruding internal ribs 202. The internal ribs 202 have a radial height 308 of sufficient size to maintain a minimum cross-sectional area of the lumen 304 when pinched with a full radius at the end, or tip, 310. The width 312 of the internal ribs 202 is sufficient to resist bending, crushing, or otherwise deforming of the rib 202 under compression such that the minimum cross-sectional area is not compromised. In one embodiment, the internal ribs 202 extend longitudinally along the heat transfer tubing 104. The internal ribs 202 are substantially continuous over the length of the heat transfer tubing 104. In another embodiment, the thickness of the wall 302 may be reduced, but the wall 302 must be thick enough to provide an impermeable barrier for the fluid.

In the illustrated embodiment, the tubing 104 has three internal ribs 202 extending radially from the wall 302 with a full radius at the end 310. In other embodiments, the tubing 104 may have one or more internal ribs 202 and the ribs 202 may take on a triangular, curved or other shape that performs the same function of keeping the lumen 304 from collapsing completely. In various embodiments, the tubing 104 is connected to various connectors 106, 108, 118 by a sealed interface between the connectors 106, 108, 118 and the outside surface of the tubing 104. In one such embodiment, the tubing is connected to various connectors 106, 108, 118 by a compression connection with a sealed interface between the connectors 106, 108, 118 and both the inside and outside surfaces of the tubing 104. In another embodiment, the tubing 104 has sufficient resiliency that a barbed section of a connector is inserted into an end of the tubing 104 to form a sealed connection to the tubing 104.

Figure 4:
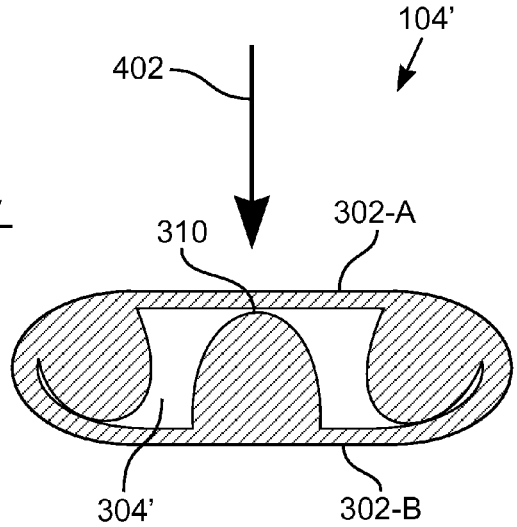
FIG. 4 is a cross-sectional view of one embodiment of the heat transfer tubing in a compressed state.

FIG. 4 illustrates a cross-sectional view of one embodiment of the heat transfer tubing 104 in a compressed state 104', as it may appear when a backpack strap or a harness in a race car seat applies an external load or force 402 on one side, or wall, 302-A of the tubing that causes that portion of the wall 302-A to be displaced toward the opposite wall 302-B of the tubing 104 as the tubing 104 deforms. The heat transfer tubing 104' is resilient and will return to its free state 104 when the compressing load or force 402 is removed. Those skilled in the art will recognize that the orientation of the ribs 202 will vary from that illustrated in FIG. 4 depending upon the orientation of the tubing 104 when the force 402 is applied.

When an external load, or force, 402 is applied to the heat transfer tubing 104, the tubing 104' deforms with a portion of the tubing wall 302-A moving toward the opposite wall portion 302-B. One or more ribs 202 prevent the two wall portions 302-A, 302-B from contacting each other and closing the lumen 304' and preventing the flow of fluid through the tubing 104'. As the two wall portions 302-A, 302-B move toward each other, at least one rib protruding from one wall portion 302-B extends toward the opposite wall portion 302-A. When the tip, or end, 310 of the rib 202 contacts the wall portion 302-A, the wall portion 302-A is stopped from contacting the opposite wall portion 302-B.

The internal ribs 202 have a height 308 and width 312 that are dimensioned to prevent the walls 302-A and 302-B from touching each other, thus maintaining the minimum cross-sectional area of the lumen 304' to minimize the impact on the heat transfer capability of the thermal garment 100. The size (height 308 and width 312) of the internal ribs 202 determines the cross-sectional area of the lumen 304 when the tubing is in its compressed state 104'.

The thermal garment 100 includes the function of resisting restriction of fluid flow. This function is implemented, in one embodiment, by the internal ribs 202. The thermal garment 100 includes heat transfer tubing 104 assembled adjacent to a material forming the garment 100 for the body or a part of the body. When an external load, or force, 402 is applied to the garment 100, the walls 302-A and 302-B are prevented from touching and closing the lumen 304' by the internal ribs 202. In its compressed state 104', the tubing maintains the lumen 304' equal to or greater than its minimum cross-sectional area.

From the foregoing description, it will be recognized by those skilled in the art that a thermal garment 100 that operates under typical loads such as the straps of a backpack or of a harness assembly has been provided. The garment 100 includes a length of heat transfer tubing 104 which carries temperature-controlled fluid. The tubing 104 has internal features that prevent the walls 302 from closing when an external load, or force, 402 is applied to the tube 104.

According to one embodiment of the present invention, a garment 100 with heat transfer tubing 104 is provided. The garment 100 has an outside surface. The heat transfer tubing 104 is attached to the garment 100, in one embodiment, by sewing the tubing 104 to the outside surface of the garment 100. The tubing 104 carries a temperature-controlled fluid that provides cooling or heating to the body. The tubing 104 has internal features that keep the lumen 304 open when pinched, or compressed, by an external force 402, such as applied by the straps of a backpack or a harness.

One embodiment of the tubing 104 has three internal ribs 202 that protrude into the lumen 304 and run longitudinally along the length of the tubing 104. The tubing 104 has an inlet 106 and an outlet 108. Temperature-controlled fluid flows into the inlet 106, runs through the tubing 104, and exits the outlet 108. When an external force 402 is applied to the tubing 104, the internal ribs 202 prevent the walls 302-A and 302-B of the tubing 104 from begin force together, thus allowing the heat transfer fluid to circulate despite the external force 402.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for thermal control of a portion of a body, said apparatus comprising:

a garment configured to cover a portion of a body, said garment having a heat transfer portion; and a length of tubing attached to said garment within said heat transfer portion by thread sewn to said garment, said length of tubing having an inlet for receiving a fluid and an outlet for discharging said fluid, said length of tubing being flexible and resilient, said length of tubing having a wall defining a lumen, said length of tubing having a plurality of ribs protruding from said wall into said lumen, said lumen having a first state with said wall forming a first conduit configuration, said lumen having a second state with one of said plurality of ribs contacting an inside surface of said wall opposite said one of said plurality of ribs forming a second conduit configuration.

2. The apparatus of claim 1 wherein said plurality of ribs extends longitudinally over substantially the length of said length of tubing.

3. The apparatus of claim 1 wherein said second state has a smaller cross-sectional area than said first state.

4. The apparatus of claim 1 wherein said length of tubing has a substantially cylindrical configuration when in said first state.

5. The apparatus of claim 1 wherein said plurality of ribs include three protrusions.

6. The apparatus of claim 1 wherein each of said plurality of ribs has a rounded tip that extends partially into the lumen.

7. The apparatus of claim 1 further including a connector, said connector and said tubing having a sealed interface, said tubing having an outside surface, said sealed interface being between said connector and said outside surface of said tubing.

8. An apparatus for thermal control of a portion of a body, said apparatus comprising:

a garment configured to cover a portion of a body, said garment having a heat transfer portion; and a length of tubing attached to said garment within said heat transfer portion, said tubing having an inlet for receiving a fluid and an outlet for discharging said fluid, said length of tubing being flexible and resilient, said length of tubing having a wall defining a lumen, said length of tubing having one or more ribs protruding from said length of tubing into said lumen, said one or more ribs dimensioned and configured to maintain a minimum cross-sectional area of said lumen when an outside force is applied to said length of tubing.

9. The apparatus of claim 8 wherein said outside force is sufficient to cause said lumen to move from a circular cross-section configuration to an oblong cross-section configuration.

10. The apparatus of claim 8 wherein said lumen has a first conduit configuration with said tubing being substantially cylindrical, said lumen having a second conduit configuration with one of said one or more ribs contacting an inside surface of said lumen opposite said one of said one or more ribs.

11. The apparatus of claim 8 wherein said lumen has a first conduit configuration with said tubing being substantially cylindrical, said lumen having a second conduit configuration with one of said one or more ribs contacting an inside surface of said lumen opposite said one of said one or more ribs, said second conduit configuration having a smaller cross-sectional area than said first conduit configuration.

12. The apparatus of claim 8 further including a connector, said connector and said tubing having a sealed interface, said tubing having an outside surface, said sealed interface being between said connector and said outside surface of said tubing.

13. An apparatus for thermal control of a portion of a body, said apparatus comprising:

a garment configured to cover a portion of a body, said garment having a heat transfer portion; and a length of tubing attached to said garment within said heat transfer portion, said heat transfer tubing having an inlet for receiving a fluid and an outlet for discharging said fluid, said length of tubing being flexible and resilient, said length of tubing having a wall defining a lumen, said length of tubing having a plurality of ribs protruding from said wall into said lumen, said plurality of ribs extending longitudinally along said length of tubing, said lumen having a first state with said length of tubing having a substantially cylindrical configuration, said lumen having a second state with one of said plurality of ribs contacting an inside surface of said wall opposite said one of said plurality of longitudinal ribs, said lumen defining a fluid conduit when said lumen is in said second state.

14. The apparatus of claim 13 wherein said plurality of ribs number at least three ribs.

15. The apparatus of claim 13 wherein said plurality of ribs extend longitudinally along substantially a full length of said length of tubing.

16. The apparatus of claim 13 wherein each of said plurality of ribs includes a member having a width and an end, said end extended partially towards a center of said lumen.

17. The apparatus of claim 16 wherein each said end is rounded.

18. The apparatus of claim 13 wherein said garment is a shirt worn on an upper body portion of a person.

19. The apparatus of claim 13 wherein said length of tubing is sewn to an outside surface of said garment.

20. The apparatus of claim 13 further including a connector, said connector and said tubing having a sealed interface, said tubing having an outside surface, said sealed interface being between said connector and said outside surface of said tubing.

* * * * *